US006435368B1

(12) United States Patent
Yamanaka et al.

(10) Patent No.: US 6,435,368 B1
(45) Date of Patent: Aug. 20, 2002

(54) EASY OPENING CAN END AND METHOD FOR FABRICATING THE SAME

(75) Inventors: Yoichiro Yamanaka; Reiko Sugihara, both of Fukuyama; Masayoshi Kurihara; Masahisa Fujikake, both of Yokohama; Yoshinori Yomura; Yuji Yamasaki, both of Fukuyama, all of (JP)

(73) Assignee: NKK Corporation, Tokyo (JP)

( * ) Notice: Subject to any disclaimer, the term of this patent is extended or adjusted under 35 U.S.C. 154(b) by 0 days.

(21) Appl. No.: 09/548,920

(22) Filed: Apr. 13, 2000

(30) Foreign Application Priority Data

Apr. 20, 1999 (JP) ..... 11-112076
Apr. 20, 1999 (JP) ..... 11-112077

(51) Int. Cl.[7] ..... B65D 17/32; B21D 51/44

(52) U.S. Cl. ..... 220/268; 220/269; 220/906; 413/15; 413/17

(58) Field of Search ..... 220/269, 906, 220/270, 268; 413/15, 16, 17, 18, 58, 67

(56) References Cited

U.S. PATENT DOCUMENTS

| | | | |
|---|---|---|---|
| 3,688,718 A | | 9/1972 | Schrecker |
| 4,276,993 A | | 7/1981 | Hasegawa |

FOREIGN PATENT DOCUMENTS

| | | |
|---|---|---|
| EP | 630703 | * 12/1994 |
| EP | 0 896 929 A | 2/1999 |
| EP | 1 044 886 A | 10/2000 |
| JP | 63-040439 | 10/1988 |
| JP | 05-040133 | 5/1993 |
| JP | 06-115546 | 4/1994 |
| JP | 06-115547 | 4/1994 |
| JP | 06-115548 | 4/1994 |
| JP | 08-099140 | 4/1996 |
| WO | 99/16676 | 4/1999 |

OTHER PUBLICATIONS

Patent Abstracts of Japan, vol. 1997, No. 08, Aug. 29, 1997 & JP 09 108756 A (Nippon Steel Corp), Apr. 28, 1997.

Aaron L. Brody, Kenneth S. March, "Encyclopedia of Packaging Technology (Second Edition)" 1997, John Wiley & Sons, Inc., United States of America XP002164252 ISBN: 0–471–06397–5, p. 419, Table 1.

* cited by examiner

*Primary Examiner*—Nathan J. Newhouse
(74) *Attorney, Agent, or Firm*—Frishauf, Holtz, Goodman, & Chick, P.C.

(57) ABSTRACT

An easy opening can end is provided whose can end panel is made of steel sheet having both sides coated with resin layers which each include at least one type of thermoplastic resin and which have elongation after break of 100% or more, tensile strength of 10 kg/mm$^2$ or more, Young modulus of 100 kg/mm$^2$ or more and a thickness in range of 10 to 100 $\mu$m. A score is formed on at least one of a front or a back side of the can end panel so as to be capable of breakage for opening the can end. The score has a bottom cross-section in a shape of an arc having a radius in a range of 0.10 to 1.0 mm, and a thinnest section of the score has a thickness t in a range of 0.025 to 0.080 mm. The easy opening can end has no problem of resin layer damage when the score is formed and has excellent can openability to such an extent that children and the aged may easily open the can end, so that the easy opening can end is most suitable for a can end of a beverage can and a food can.

8 Claims, 5 Drawing Sheets

EASY OPENING CAN END AND METHOD FOR FABRICATING THE SAME

BACKGROUND OF THE INVENTION

1. Field of the Invention

The present invention relates to an easy opening can end used for a can end of a beverage can and a food can and more particularly to an easy opening can end made of steel sheet coated with resin layers, and to a method for fabricating the same.

2. Description of Related Art

An easy opening can end is widely used to open a can by breaking an opening section formed at a can end through pulling up a tab attached to the can end by use of fingers and the like. The above opening section is formed at the can end of the can accommodating various beverages of beer, juice, coffee and the like or food. The easy opening can end is largely classified as a partial opening can end mainly used for beverage cans and as a full opening can end mainly used for food cans. For the partial opening can end, there are a pull-top tab can end and a stay-on tab can end.

FIG. 1 is a plan view showing an example of the pull-top tab can end.

A tab 3 is secured to the center of a central panel section 11 of the can end 1 made of metal sheet of steel or aluminum alloy or the like by way of a rivet mechanism 9. By pulling up the tab 3 by fingers or the like, a working end of the tab 3 pushes down through an action of a lever a broken opening section 5, where a score 2 is engraved in the central panel section 11, so that the score 2 is broken. Furthermore, by pulling up the tab 3, a broken opening section piece may be completely separated to open the can end 1.

FIG. 2 is a plan view showing an example of the stay-on tab can end.

As similar to FIG. 1, when the working end of the tab 3 is pulled up subsequent to breakage of the score 2, breakage will progress and a part of the broken opening section piece is pushed down inside the can body as is connected to the can end 1, thus enabling the can end 1 to be opened.

On the other hand, in the case of the full opening can end, the score engraved around the outer circumference of the can end is broken by a pull up with fingers or the like of the tab attached to the panel section in the neighborhood of the outer circumference of the can end, and similar to the can end of the pull-top tab can end, the opening section piece is removed from the can end and the can end is opened.

Conventionally, as shown in FIG. 3, the score of such easy opening can end is formed by press forming to create a V-shaped cross-section by providing such high load to make the depth of the score having more than half thickness of the can end 1 by use of a tool 12 having a knife edge protrusion formed according to a contour of a predetermined opening section. At this time, in case steel sheet coated with resin layers is used, there is a problem that resin layers of the outside of the can end are subjected to damage and corrosion resistance is deteriorated. To avoid this, a counter measure is normally taken to prevent deterioration of corrosion resistance by providing supplementary coating after press forming. Of late, there is an example that a can end made of aluminum alloy is used, but it is high in cost and presents a problem of recycling.

In addition, a number of methods are presented to prevent resin layer damage caused when using steel sheet coated with resin layers. For instance, according to Japanese Laid-open Patent Applications Nos. 6-115546, 6-115547 and 6-115548, the methods for forming the score by compound extrusion are proposed. It is reported that by these methods resin layer damages do not occur and supplementary coating is not required. However, working condition of compound extrusion and the detail of forming the score are not clear and it is doubtful whether the score is stably formed. According to Japanese Laid-open Patent Application No. 8-99140, a method for forming the score is disclosed that by using upper and lower dies having the shoulder radius of 0.1 to 1.0 mm, the score is formed to have the thickness of its thinnest section to be not exceeding half of the original thickness. However, can opening force is determined by the absolute value of the thickness of the thinnest section of the score as well as by strength, so that it does not necessarily follow that good can openability may be obtained even if the thickness of the thinnest section is arranged to be less than half of the original thickness.

On the other hand, with respect to improvement of can openability for the easy opening can end made of steel sheet, for instance, Japanese Utility Model Registration No. 63-40439 discloses a method for broadening a clearance made between the central panel section of the can end and the finger picking section of the tab by forming a recessed part for inserting fingers to the central panel section below the finger picking section of the tab in order to facilitate insertion of fingers and picking of finger picking section. And also, Laid-open Japanese Utility Model Registration No. 5-40133 discloses a method that the tab is riveted in the degree of rotatably moving to the openable position where the central axis of the tab coincides with that of the broken opening section from the unopenable position where the central axis of the tab deviates from that of the broken opening section, and during the tab moves from the unopenable position to the openable position, the finger picking section of the tab is raised up by tapered protrusion set up at the central panel section located between the rivet and the finger picking section, thereby facilitating insertion of a finger to the clearance between the central panel section and the finger picking section as well as picking of a finger to finger picking section. In either case, however, there is no difference in force for pulling up the tab, so that can openability is not improved to such an extent that children and the aged may open cans easily.

SUMMARY OF THE INVENTION

The present invention has been made to solve the above mentioned problems. Its object is to provide has an easy opening can end which is made of steel sheet coated with resin layers that are not damaged at the time of forming a score theron, and which has can openability in the degree that children and the aged may easily open the can end. In addition, the present invention provides a method for fabricating such an easy opening can end.

The object of the present invention may be achieved by an easy opening can end whose can end panel is made of steel sheet having both sides coated with resin layers which each comprise at least one type of thermoplastic resin and which have elongation after break of 100% or more, tensile strength of 10 kg/mm$^2$ or more, Young modulus of 100 kg/mm$^2$ or more and a thickness in range of 10 to 100 $\mu$m. A score is formed on at least one of a front or a back side of the can end panel so as to be capable of breakage for opening the can end. The score has a bottom cross-section in a shape of an arc having a radius in a range of 0.10 to 1.0 mm, and a thinnest section of the score has a thickness t in a range of 0.025 to 0.080 mm.

Additionally, the easy opening can end described above according to the present invention may be fabricated by a step of forming a can end panel with steel sheet having both sides coated with resin layers which each comprise at least one type of thermoplastic resin and which have elongation after break of 100% or more, tensile strength of 10 kg/mm$^2$ or more, Young modulus of 100 kg/mm$^2$ or more and a thickness in range of 10 to 100 $\mu$m, and a step of forming a score on the can end panel by press forming using a pair of dies, at least one of which has a shape of a curved surface with a radius in a range of 0.10 to 1.0 mm, and so that a thickness of a thinnest section t of the score is 0.025 to 0.080 mm.

DETAILED DESCRIPTION OF THE INVENTION

Figure 1:
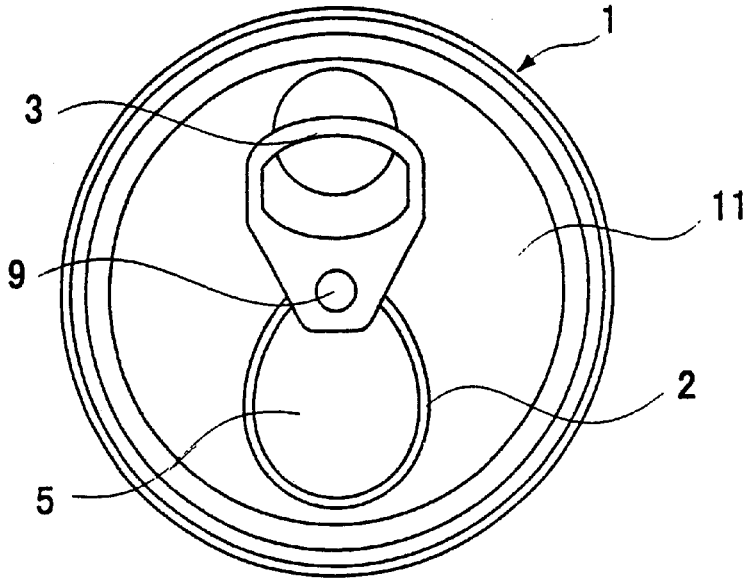
FIG.1 (PRIOR ART)
FIG. 1 is a plan view illustrating an example of a pull-top tab can end.

When studies have been made about resin layer damage at the time of forming a score for an easy opening can end made of steel sheet coated with resin layers as well as about can openability, it has proved to be efficient that in order to prevent resin layer damage, mechanical characteristics and thickness of resin should be controlled, and in order to improve can openability, shape and thickness of the score should be controlled. Hereunder, there is described in detail.

1) Mechanical Characteristics of Resin Layers and a Thickness Thereof

In order to prevent resin layer damage at the time of forming the score, a need exists that resin layers should have excellent workability capable of adherently following the deformation of bare steel sheet. For this purpose, it is required that elongation after break according to the standard of ASTM-D822 should be 100% or more, or preferably 200% or more, tensile strength of the above standard should be 10 kg/mm$^2$ or more, and Young modulus of the above standard should be 100 kg/mm$^2$ or more and yet thickness of the resin layers should be in a range of 10 to 100 $\mu$m. If the elongation after break is less than 100% or tensile strength is less than 10 kg/mm$^2$, layers are easy to break at the time of forming the score and if Young modulus is less than 100 kg/mm$^2$, the layers are scraped away or easily subjected to damage due to friction with dies. And if thickness of resin layers is less than 10 $\mu$m, the layers are easy to break, and if thickness exceeds 100 $\mu$m, film hair occurs at the edge of the can end or cost-increase is resulted.

In consideration of workability described above, food hygienics, corrosion resistance and the like, such resin layers may adopt resin film composed of one or tow types or more of thermoplastic resin such as polyester, polyamide or the like. Among them, it is more desirable to adopt film composed of single or double layered polyester resin because the same has high elongation after break, high tensile strength and high Young modulus. Specifically, it refers to linear thermoplastic polyester film represented by polyethylene terephthalate (PET) obtainable by condensation polymerization of dicarboxylic acid and diol. For the dicarboxylic acid, an individual one or mixture of terephthalic acid, isophthalic acid, phthalic acid and the like are used, and for the diol, ethylene glycol, butadiene glycol, decandiol and the like are used individually or mixedly. Copolymers made from 2 or more types of dicarboxylic acid or diol as well as copolymers made from other monomers including diethylene glycol and other polymers may also be applicable. For lamination of the steel sheet, there are methods wherein the film itself is bonded thermally or stuck on the surface of the steel sheet by application of thermosetting adhesive.

2) Shape and Thickness of the Score

It has conventionally been considered that break of the score at the time of opening cans is caused by shearing deformation and based on such consideration the shape of the score has been designed. Our recent studies have revealed that break of the score is caused not by shearing deformation but mainly by tension deformation, and it has proved to be the most effective that the absolute value of thickness at the thinnest section of the score should be made small in order to decrease can opening force.

Figure 4:
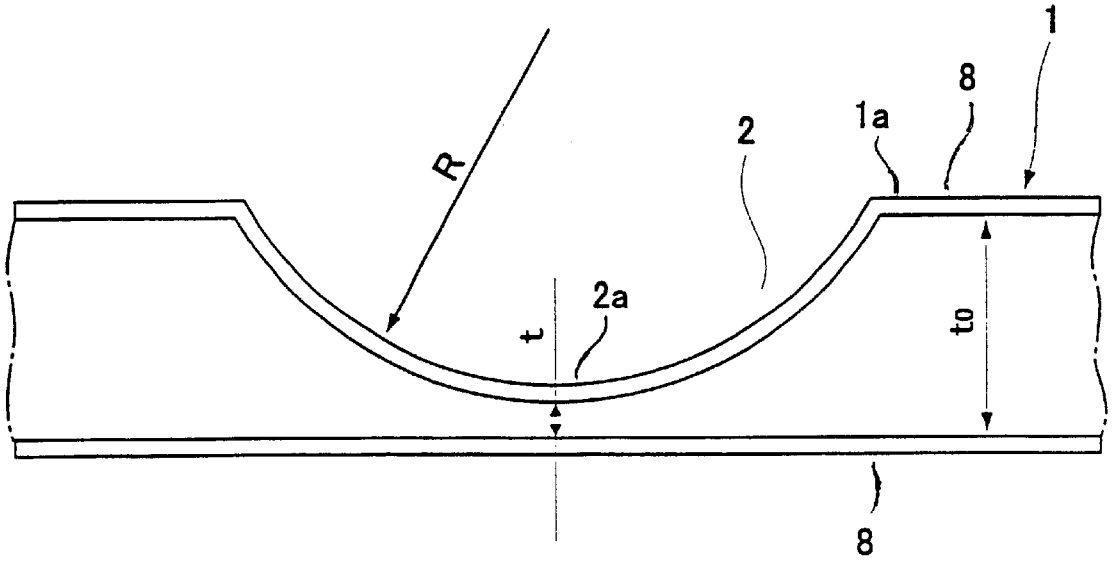
FIG. 4 is a sectional view illustrating a score section of an easy opening can end which is an embodiment of the present invention.

FIG. 4 shows a sectional view illustrating a score section of an easy opening can end which is an embodiment of the present invention.

Can opening force may stably be decreased to such an extent that children and the aged are capable of opening cans by forming the score 2 having an arc shaped cross-section with a radius R in the range of 0.10 to 1.0 mm and with a thickness t in the range of 0.025 to 0.080 mm at the thinnest section 2*a* on the surface 1*a* of the can end 1 having both sides coated with resin layers 8 in a thickness of $t_o$.

In case a radius R of the score 2 is less than 0.10 mm, a tip radius of a die for working the score is compelled to be made small, which leads to a large face pressure, and presents difficulty in forming the score 2 on the can end panel without causing resin layer damage. In case a radius R of the score 2 exceeds 1.0 mm, an area of the thin section in the can end 1 becomes large, so that broken position of the can opening section becomes unstable and the shape of the can opening section deteriorates, and moreover a "sag" which is a hanging of a part of the broken section becomes large. It is practically difficult to form the score 2 having width of exceeding 1.0 mm on the can end panel which is limited in space.

In case thickness t of the thinnest section 2*a* in the score 2 is less than 0.025 mm, not only the resin layers are damaged at the time of working but also a fear exists that the can end panel is broken. For the can body having such can end, there is a danger that the opening section is broken when it is subjected to impacts or the like from the outside including dropping. If a thickness t of the thinnest section 2*a* in the score 2 exceeds 0.080 mm, larger can opening force is required.

Figure 5:
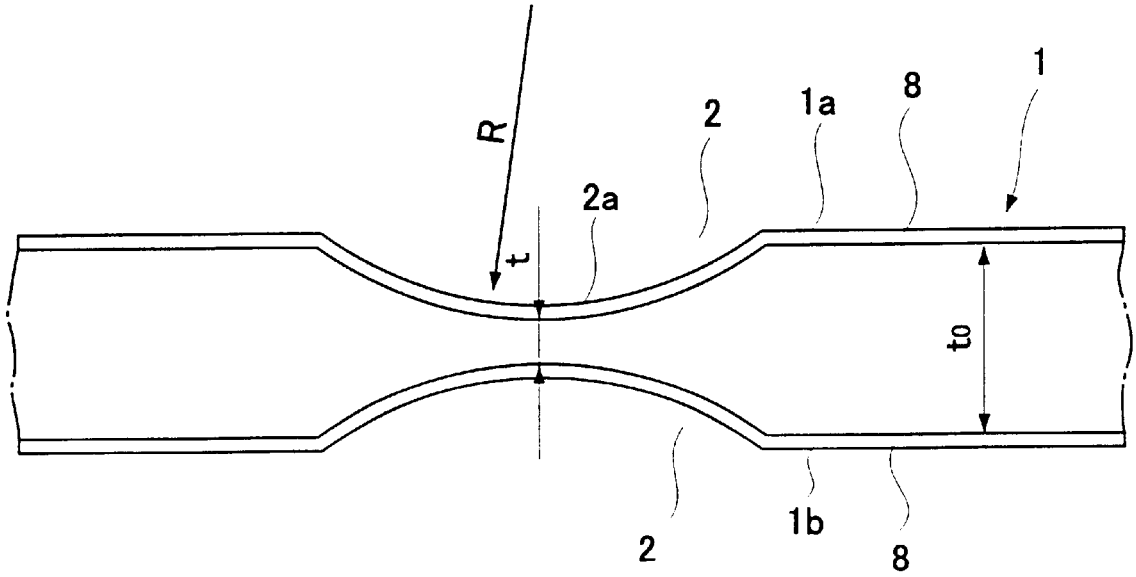
FIG. 5 is a sectional view illustrating a score section of an easy opening can end which is another embodiment of the present invention.

FIG. 5 is a sectional view illustrating a score section of an easy opening can end which is another embodiment of the present invention. A similar effect may be obtained even if the score 2 having similar cross-sectional shape to FIG. 4 is formed on both sides of the front 1*a* and the back 1*b* of the can end 1.

When the score 2 is formed by press forming, work hardening occurs in the thinnest section and strength increases. The degree of work hardening differs in accordance with a ratio of the original thickness $t_o$ of steel sheet to thickness t after worked thereof, and the strength of the thinnest section has become the larger when t is the smaller.

Now, when effective stress is σ and effective strain is ϵ. The following expression is given;

$$\sigma = K \times \epsilon^n \tag{2}$$

Suppose n expresses work hardening coefficient in the range of 40 to 90% of uniform elongation of steel sheet used for the can end and tensile strength TS kgf/mm$^2$, TS is given by $TS = K \times n^n / \exp(n)$, so K is expressed by;

$$K = TS \times \{\exp(n)/n^n\} \tag{3}$$

The strain occurred in the thickness direction when forming the score is expressed by ϵt, which is given by;

$$\epsilon t = \mathrm{In}[1 + (t - t_o)/t_o] \tag{4}$$

ϵ which is the effective strain at the thinnest section in the score is supposed to be plane strain and expressed by the following;

$$\epsilon = 2 \times 3^{-1/2} \times |\mathrm{In}[1 + (t - t_o)/t_o]| \tag{5}$$

From equations (2), (3) and (5), effective stress at the thinnest section is expressed by the following;

$$\sigma = TS \times \{\exp(n)/n^n\} \times \{2 \times 3^{-1/2} \times |\mathrm{In}[1 + (t - t_o)/t_o]|\}^n \tag{6}$$

Tension breaking force P when breaking the thinnest section of the score mainly by tension deformation is expressed by the following;

$$P = \sigma \times t \tag{7}$$

so that;

$$P = t \times TS \times \{\exp(n)/n^n\} \times \{2 \times 3^{-1/2} \times |\mathrm{In}[1 + (t - t_o)/t_o]|\}^n \tag{1}$$

Consequently, the smaller is P, can opening force may be decreased, but in case a thickness t of the thinnest section is in a range of 0.025 to 0.080 mm as described above, more excellent can openability may be obtained when P is given by not exceeding 5.0.

Further, in case steel sheet is used with TS being 40 kg/mm$^2$ or below, there is a case where the opening section is broken when impact from the outside including dropping of the can body is given at the time P becomes 2.5 or below. Under the circumstance, it is desirable that P should be 2.5 or more.

Figure 2:
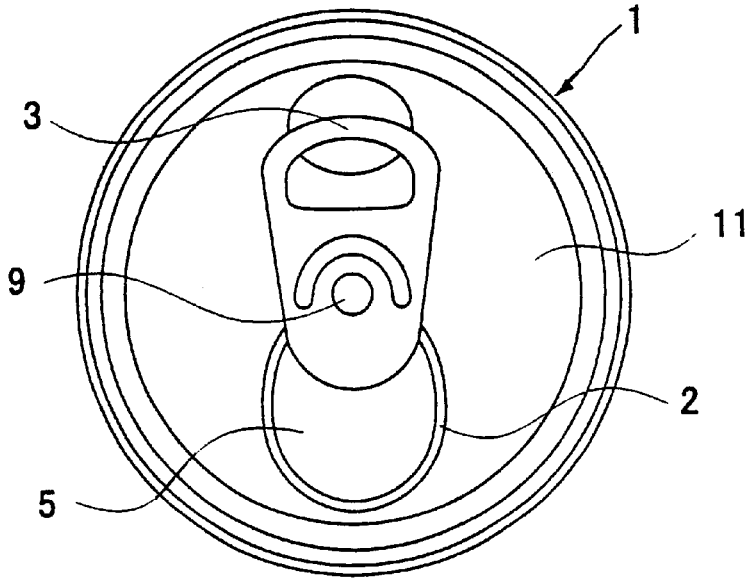
FIG.2 (PRIOR ART)
FIG. 2 is a plan view illustrating an example of a stay-on tab can end.
Figure 3:
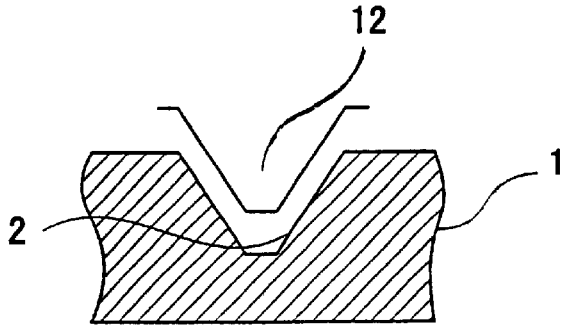
FIG.3 (PRIOR ART)
FIG. 3 shows a method for forming a conventional score.

Such easy opening cans according to the present invention are applicable to the pull-top tab can end illustrated in FIG. 1 as well as the stay-on tab can end illustrated in FIG. 2.

Figure 6A:
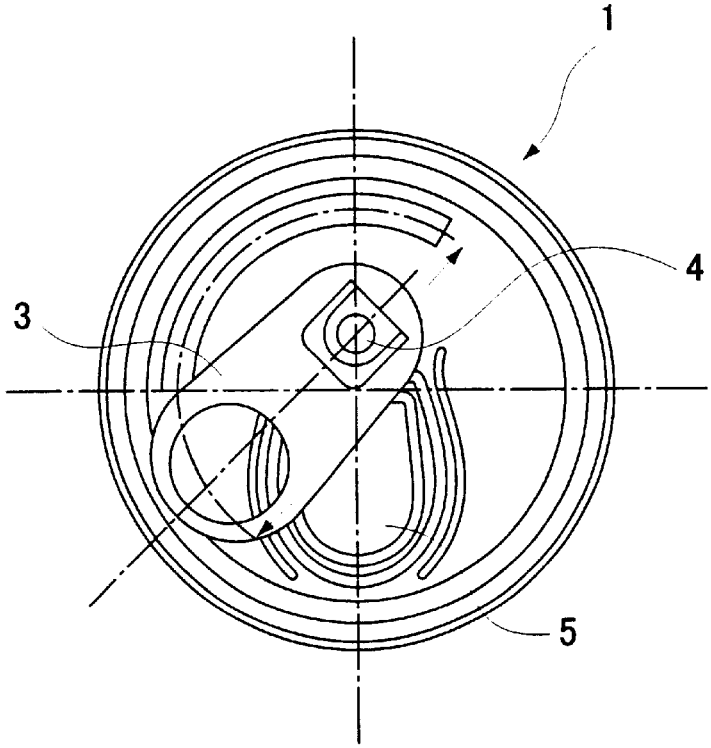
FIGS. 6A and 6B are plan views illustrating an easy opening can end which is a still another embodiment of the present invention.
Figure 6B:
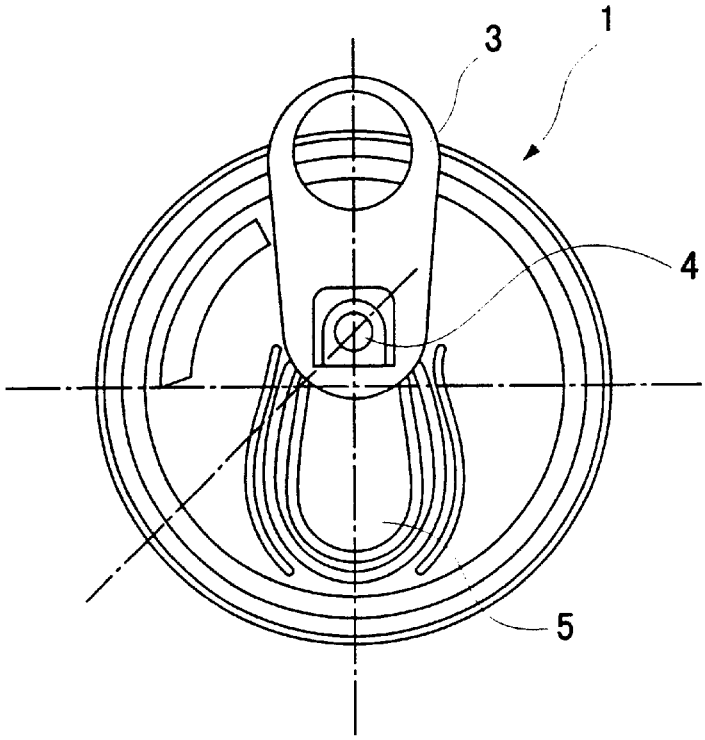

Can opening force may be substantially decreased by applying the can end according to the present invention to the can end 1 in such manners that, as shown in FIG. 6A, the tab 3 should be rotatable around the tab fixture 4 on the can end 1, the position of the tab fixture 4 should be shifted from the center of the can end 1 to the opposite side of the broken opening section 5 by the predetermined amount of length, and moreover, the length from the tab fixture 4 of the tab 3 to the tab finger picking section should be longer than conventional to make the generated force large at the point of action and that, as shown in FIG. 6B, when the tab 3 is rotated at the position where the can end is openable, the edge section of the pull-up side of the tab 3 should be located outside the outer circumference of the can end 1.

The easy opening can end as described above according to the present invention may be fabricated by such methods that the can end panel is worked by using steel sheet having both sides coated with resin layers which are composed of one or 2 types or more of thermoplastic resin and have elongation after break of 100% or more, tensile strength of 10 kg/mm$^2$ or more, Young modulus of 100 kg/mm$^2$ or more and a thickness of 10 to 100 μm, and subsequently, on the same can end panel, the score should be formed by press working so as to provide thickness of 0.025 to 0.080 mm at the thinnest section by use of a pair of the dies with at least either die having the curved shape in a radius of 0.10 to 1.0 mm which is required for forming the score having an arc-shaped cross-section in a radius of 0.10 to 1.0 mm.

Further, in this method of fabrication, if P as expressed by the above described equation (1) is made to be ranging from 2.5 to 5.0, it may be possible to fabricate the easy opening can end having more excellent can openability.

When liquid or solid lubricant is used for press working of the score, friction force existing between the dies and resin may be made small and shearing force generated in resin becomes small, so that peeling of resin may certainly be prevented, which is more desirable.

Steel sheet to be used for the easy opening can end according to the present invention is not particularly limited in the specification, but upon forming rivet mechanism for securing the tab, it is more desirable that work hardening coefficient n of steel sheet should be 0.15 or more under uniform elongation in a range of 40 to 90%. And, for the purpose of ensuring corrosion resistance as well as adhesion with resin layers, various coating or chemical treatment may be executed on either side of a front or a back or both sides of steel sheet.

For preventing resin layer damage, it is desirable to make small the face pressure at the time of working the score, and for this purpose, it is to be desired to satisfy the expression of $$TS\times\{\exp(n)/n^n\}\times\{2\times3^{-1/2}\times|In[1+(t-t_o)/t_o]|\}^n\leqq70.$$

EXAMPLE 1

A can end panel has been fabricated by use of tin-free steel sheet having a thickness $t_o$ of 0.25 mm and tensile strength TS of 44 kg/mm$^2$, formed with chromium metal layer of 120 mg/m$^2$ by chromate treatment and subsequently formed with chromium hydration oxide of 15 mg/m$^2$ reduced to chromium metal, and then laminated on both sides of a front and a back with resin film of polyethylene terephthalate, oriented polypropylene (OPP), oriented nylon (ON), low density polyethylene (LDPE) and polyvinyl alcohol (PVA), which are shown in Table A and Table B. And, according to work condition shown in Table 1 and Table 2, an easy opening can end of a stay-on tab type is worked with press working and secured to a can body, which refer to samples Nos. 1–44. Samples Nos. 1 to 20 refer to the can bodies having the easy opening can ends according to the present invention, in which the characteristics of resin layers (types, elongation after break: ElR, tensile strength: TSr, Young modulus: Er, thickness: tr), a radius R of the bottom cross-section of the score and the thickness of the thinnest section t are within the scope of the present invention. Samples Nos. 21 to 43 refer to the can bodies with the easy opening can ends in which at least one condition out of the characteristics of resin layers, the radius R of the bottom cross-section of the score and the thickness of the thinnest section t is out of the scope of the present invention. Meanwhile, press working has been conducted in both cases, with using lubricant or without using lubricant. And, against samples Nos. 1 to 43 fabricated, by application of the following methods, investigation has been made about can openability, and the existence of resin layer damage, resin layer peeling and impact fracture.

Can openability: This has been evaluated by Pop value (kg), which is an initial force by which an opening section of the score begins opening when a tab of the can end is pulled up by a certain amount of force. If Pop value is not exceeding 2.4, it may be said that the can end has an excellent can openability equal to the easy can end made of aluminum alloy sold in the market.

Resin layer damage: By conducting corrosion resistance test for the can body, evaluation has been made whether stain occurs (×) or not (○) on the score of the front and the back of the can end and its neighborhood. ○ shows entirely no occurrence of stain on the front and the back and × shows otherwise.

Resin layer peeling: Evaluation has been made by observation of the cross-section whether resin layer peeling occurs (×) or not (○)

Figure 7A:
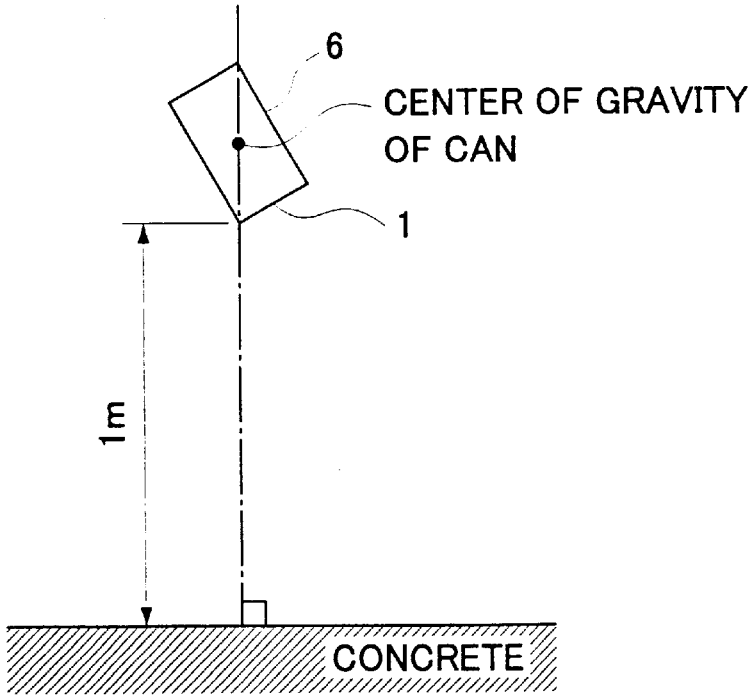
FIG. 7A is a view illustrating a testing method for impact fracture.
Figure 7B:
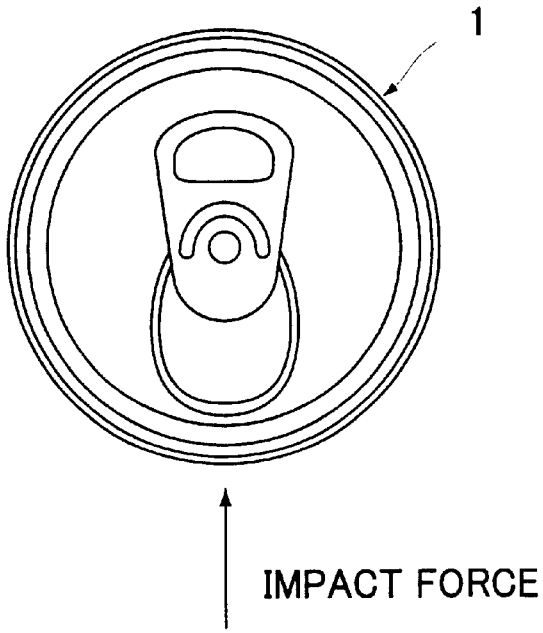
FIG. 7B is a view illustrating a direction of impact force according to FIG. 7A.

Impact fracture: Evaluation has been made whether impact fracture occurs (×) or not (○) when impact force is added to the can end 1 from the direction shown by an arrow in FIG. 7B, after a can body 6 being dropped on the concrete floor from the height of 1 m with the can end 1 directing toward downward. Results are shown in Table 1 and Table 2.

In samples Nos. 1 to 20 with the easy opening can ends according to the present invention, either can has low Pop value not exceeding 2.4 kg, which provides excellent can openability, and resin layer damage, resin layer peeling and impact fracture do not occur. Further, good opening shape may be acquired.

On the other hand, in samples Nos. 21 to 29 which are out of the scope in the characteristics of resin layers and in samples Nos. 30 to 34 in which R is smaller than the scope of the present invention, resin layer damage and resin layer peeling occur in either case. In samples Nos. 30 and 33 in which t is smaller than the scope of the present invention, impact fracture occurs. In sample No. 35 where R is smaller than the scope of the present invention and t is larger than that of the present invention, Pop value is as high as 2.8 kg, leading to inferior can openability. In samples Nos. 36 to 39 and 41 where t is smaller than the scope of the present invention, resin layer damage, resin layer peeling and impact fracture occur in either case. In samples Nos. 40 and 42 where t is larger than the scope of the present invention, Pop value is high, 2.8 kg or more, and can openability is inferior. In samples Nos. 41 and 43 where t is smaller than the scope of the present invention, impact fracture occurs. Meanwhile, in samples Nos. 21 to 23 where R is larger than the scope of the present invention, good opening shape may not be acquired.

TABLE 1

| Sample | Resin film | | | | | Press forming conditions | | | Pop | Resin layer | | Impact | |
|---|---|---|---|---|---|---|---|---|---|---|---|---|---|
| No. | Resin | Elr (%) | TSr (kg/mm2) | Er (kg/mm2) | tr (μm) | R (mm) | t (mm) | Lubricant | Value (kg) | Damage | Peeling | fracture | Note |
| 1 | PET | 200 | 23 | 300 | 25 | 0.1 | 0.025 | no | 1.0 | ○ | ○ | ○ | Invention |
| 2 | PET | 200 | 23 | 300 | 50 | 0.1 | 0.025 | yes | 1.2 | ○ | ○ | ○ | Invention |
| 3 | PET | 200 | 23 | 300 | 25 | 0.1 | 0.05 | no | 1.5 | ○ | ○ | ○ | Invention |
| 4 | PET | 200 | 23 | 300 | 50 | 0.1 | 0.05 | yes | 1.4 | ○ | ○ | ○ | Invention |
| 5 | PET | 200 | 23 | 300 | 20 | 0.1 | 0.08 | no | 2.4 | ○ | ○ | ○ | Invention |
| 6 | OPP | 140 | 20 | 250 | 50 | 0.1 | 0.05 | no | 1.5 | ○ | ○ | ○ | Invention |
| 7 | OPP | 140 | 20 | 250 | 50 | 0.1 | 0.05 | yes | 1.4 | ○ | ○ | ○ | Invention |
| 8 | PET | 200 | 23 | 300 | 25 | 0.2 | 0.025 | yes | 0.9 | ○ | ○ | ○ | Invention |
| 9 | ON | 120 | 22 | 170 | 50 | 0.2 | 0.025 | yes | 1.0 | ○ | ○ | ○ | Invention |
| 10 | PET | 200 | 23 | 300 | 25 | 0.5 | 0.025 | yes | 1.1 | ○ | ○ | ○ | Invention |
| 11 | PET | 200 | 23 | 300 | 50 | 0.8 | 0.025 | yes | 1.2 | ○ | ○ | ○ | Invention |
| 12 | PET | 200 | 23 | 300 | 25 | 0.8 | 0.05 | no | 1.4 | ○ | ○ | ○ | Invention |

TABLE 1-continued

| Sample No. | Resin film: Resin | Elr (%) | TSr (kg/mm2) | Er (kg/mm2) | tr (μm) | Press forming conditions: R (mm) | t (mm) | Lubricant | Pop Value (kg) | Resin layer: Damage | Peeling | Impact fracture | Note |
|---|---|---|---|---|---|---|---|---|---|---|---|---|---|
| 13 | PET | 200 | 23 | 300 | 50 | 0.8 | 0.05 | yes | 1.3 | ○ | ○ | ○ | Invention |
| 14 | PET | 200 | 23 | 300 | 25 | 0.8 | 0.08 | yes | 2.3 | ○ | ○ | ○ | Invention |
| 15 | ON | 120 | 22 | 170 | 50 | 0.8 | 0.05 | no | 1.4 | ○ | ○ | ○ | Invention |
| 16 | ON | 120 | 22 | 170 | 50 | 0.8 | 0.05 | yes | 1.3 | ○ | ○ | ○ | Invention |
| 17 | PET | 200 | 23 | 300 | 50 | 1.0 | 0.025 | yes | 1.1 | ○ | ○ | ○ | Invention |
| 18 | PET | 200 | 23 | 300 | 25 | 1.0 | 0.05 | no | 1.5 | ○ | ○ | ○ | Invention |
| 19 | PET | 200 | 23 | 300 | 50 | 1.0 | 0.05 | yes | 1.6 | ○ | ○ | ○ | Invention |
| 20 | PET | 200 | 23 | 300 | 25 | 1.0 | 0.08 | yes | 2.4 | ○ | ○ | ○ | Invention |

TABLE 2

| Sample No. | Resin film: Resin | Elr (%) | TSr (kg/mm2) | Er (kg/mm2) | tr (μm) | Press forming conditions: R (mm) | t (mm) | Lubricant | Pop Value (kg) | Resin layer: Damage | Peeling | Impact fracture | Note |
|---|---|---|---|---|---|---|---|---|---|---|---|---|---|
| 21 | LDPE | 400 | 2 | 15 | 50 | 0.1 | 0.05 | no | 1.0 | X | X | ○ | Comparison |
| 22 | LDPE | 400 | 2 | 15 | 50 | 0.2 | 0.05 | yes | 1.3 | X | X | ○ | Comparison |
| 23 | LDPE | 400 | 2 | 15 | 50 | 0.5 | 0.05 | no | 1.4 | X | X | ○ | Comparison |
| 24 | LDPE | 400 | 2 | 15 | 50 | 0.8 | 0.05 | yes | 1.4 | X | X | ○ | Comparison |
| 25 | LDPE | 400 | 2 | 15 | 50 | 1.0 | 0.05 | no | 1.5 | X | X | ○ | Comparison |
| 26 | PVA | 60 | 17 | 400 | 50 | 0.2 | 0.05 | yes | 1.3 | X | X | ○ | Comparison |
| 27 | PVA | 60 | 17 | 400 | 50 | 0.5 | 0.05 | no | 1.4 | X | X | ○ | Comparison |
| 28 | PVA | 60 | 17 | 400 | 50 | 0.8 | 0.05 | yes | 1.4 | X | X | ○ | Comparison |
| 29 | PET | 200 | 23 | 300 | 5 | 0.5 | 0.05 | no | 1.3 | X | ○ | ○ | Comparison |
| 30 | PET | 200 | 23 | 300 | 25 | 0.01 | 0.02 | no | 0.8 | X | X | X | Comparison |
| 31 | PET | 200 | 23 | 300 | 25 | 0.01 | 0.05 | no | 1.6 | X | X | ○ | Comparison |
| 32 | PET | 200 | 23 | 300 | 25 | 0.01 | 0.10 | no | 2.4 | X | X | ○ | Comparison |
| 33 | PET | 200 | 23 | 300 | 25 | 0.08 | 0.02 | no | 0.9 | X | X | X | Comparison |
| 34 | PET | 200 | 23 | 300 | 25 | 0.08 | 0.05 | no | 1.6 | X | X | ○ | Comparison |
| 35 | PET | 200 | 22 | 300 | 25 | 0.08 | 0.10 | no | 2.8 | ○ | ○ | ○ | Comparison |
| 36 | PET | 200 | 22 | 300 | 25 | 0.1 | 0.02 | no | 0.8 | X | X | X | Comparison |
| 37 | PET | 200 | 23 | 300 | 25 | 0.2 | 0.02 | no | 0.7 | X | X | X | Comparison |
| 38 | PET | 200 | 23 | 300 | 25 | 0.5 | 0.02 | no | 0.9 | X | X | X | Comparison |
| 39 | PET | 200 | 23 | 300 | 25 | 0.8 | 0.02 | no | 1.0 | X | X | X | Comparison |
| 40 | PET | 200 | 23 | 300 | 25 | 0.8 | 0.10 | no | 2.8 | ○ | ○ | ○ | Comparison |
| 41 | PET | 200 | 23 | 300 | 25 | 1.2 | 0.02 | no | 0.9 | X | X | X | Comparison |
| 42 | PET | 200 | 23 | 300 | 25 | 1.2 | 0.10 | no | 3.0 | ○ | ○ | ○ | Comparison |

EXAMPLE 2

A can end panel has been fabricated by use of tin-free steel sheet having a thickness $t_o$ of 0.25 mm and tensile strength TS of 44 kg/mm$^2$, formed with chromium metal layer of 120 mg/M$^2$ and subsequently formed with chromium hydration oxide of 15 mg/m$^2$ reduced to chromium metal, and then laminated on both sides of a front and a back with PET (Elr: 200%, TSr: 23 kg/mm$^2$, Er: 300 kg/mm$^2$, tr: 25 μm). And, by using a pair of dies having one side in curved shape and the other side in flat shape, an easy opening can end of a stay-on tab type has been worked by press working in changing a tip radius R of the one side of the dies (a radius of a bottom cross-section of the score) and the thinnest thickness t of the score, thereby having investigated whether or not resin layer damage occurs.

Figure 8:
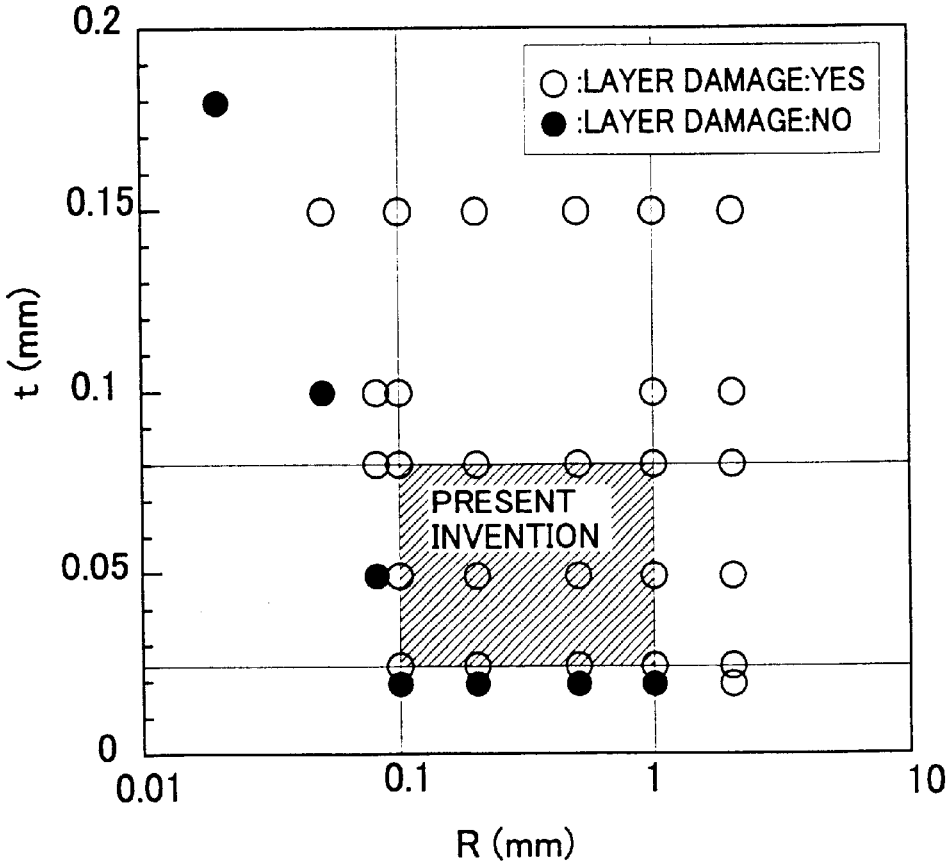
FIG. 8 is a view showing occurrence of resin layer damage and its relation between R and t.

FIG. 8 shows occurrence of resin layer damage and its relation with R and t.

If the radius R of the bottom cross-section of the score is in the range of 0.10 to 1.0 mm and the thickness of the thinnest section t is in the range of 0.025 to 0.080 mm, it proves that resin layer damage does not occur.

EXAMPLE 3

A can end panel has been fabricated by using tin-free steel sheet having a thickness $t_o$ of 0.20 to 30 mm and tensile strength TS of 29 to 56 kg/mm$^2$, formed with chromium metal layer of 100 to 120 mg/m$^2$ by chromate treatment and subsequently formed with chromium hydration oxide of 14 to 18 mg/m$^2$ reduced to chromium metal, and then laminated on both sides of a front and a back with resin film of PET, OPP and ON as shown in Table 3. And by using a pair of dies both sides having curved surfaces with a tip radius R being 0.10 to 1.0 mm, or a pair of the dies having one side in curved surface type with the tip radius R being 0.10 to 1.0 mm and the other side in flat type, an easy opening can end of a stay-on tab type has been worked by press working. Such can ends have been secured to can bodies to make samples Nos. 1 to 17. Meanwhile, press working has been conducted in the case of using lubricant and in the case of not using lubricant. And, against fabricated samples Nos. 1 to 17, investigation has been conducted according to the methods described above about can openability and the occurrence of resin layer damage, resin layer peeling and impact fracture.

A result is shown in Table 3.

Samples Nos. 1 to 17 have the easy opening can end in which the characteristics of resin layers, the radius R of the bottom cross-section of the score and the thickness of the thinnest section t are within the scope of the present invention, so that they have excellent can openability and there are no occurrences of resin layer damage and resin layer peeling. Particularly, in samples Nos. 1 to 13 having P value expressed in the above equation (1) not exceeding 5.0, Pop value is not more than 1.2 kg and excellent can openability is provided. However, in samples Nos. 1 to 5 using steel sheet with tensile strength not exceeding 40 kg/mm$^2$, impact fracture has occurred as P value is less than 2.5.

$$P=t\times TS\times\{\exp(n)/n^n\}\times\{2\times 3^{-1/2}\times|\ln[1+(t-t_o)/t_o]|\}^n$$

where $t_o$: thickness (mm) of the steel sheet;

n: work hardening coefficient of uniform elongation in a range of 40 to 90%; and TS: tensile strength (kg/mm$^2$) of the steel sheet.

4. An easy opening can end according to claim 3, wherein said resin layers include at least one layer of polyester resin.

5. A method for fabricating an easy opening can end comprising:

working a steel sheet to form a can end panel, said steel sheet having both sides coated with resin layers which each comprise at least one thermoplastic resin, and said resin layers having elongation after break of 100% or more, tensile strength of 10 kg/mm$^2$ or more, Young modulus of 100 kg/mm$^2$ or more and a thickness in a range of 10 to 100 $\mu$m;

forming a score on said can end panel by press working using a pair of dies, wherein at least one of said dies comprises a curved surface of a radius in a range of 0.10 to 1.0 mm, and wherein said score is formed to have a thinnest section having a thickness in a range of 0.025 to 0.080 mm.

TABLE 3

| Sample | Resin film | | | | | Steel sheet | | | Press forming conditions | | | | Pop | Resin layer | | Impact |
|---|---|---|---|---|---|---|---|---|---|---|---|---|---|---|---|---|
| No. | Resin | Elr (%) | TSr (kg/mm2) | Er (kg/mm2) | tr ($\mu$m) | $t_o$ (mm) | TS (kg/mm2) | n | R (mm) | t (mm) | Lubricant | P | Value (kg) | Damage | Peeling | fracture |
| 1 | PET | 200 | 23 | 300 | 25 | 0.20 | 28.5 | 0.113 | 0.1 | 0.04 | no | 1.8 | 0.7 | ○ | ○ | X |
| 2 | PET | 200 | 23 | 300 | 25 | 0.30 | 28.5 | 0.203 | 0.5 | 0.04 | yes | 2.3 | 0.9 | ○ | ○ | X |
| 3 | PET | 200 | 23 | 300 | 25 | 0.20 | 30.2 | 0.114 | 0.5 | 0.04 | no | 1.9 | 0.8 | ○ | ○ | X |
| 4 | PET | 200 | 23 | 300 | 25 | 0.30 | 35.4 | 0.141 | 0.1 | 0.04 | yes | 2.4 | 0.9 | ○ | ○ | X |
| 5 | PET | 200 | 23 | 300 | 25 | 0.20 | 40.4 | 0.105 | 0.5 | 0.04 | no | 2.4 | 0.9 | ○ | ○ | X |
| 6 | PET | 200 | 23 | 300 | 25 | 0.30 | 28.5 | 0.158 | 0.1 | 0.08 | no | 4.2 | 1.1 | ○ | ○ | ○ |
| 7 | PET | 200 | 23 | 300 | 25 | 0.30 | 28.5 | 0.231 | 0.5 | 0.08 | yes | 4.4 | 1.2 | ○ | ○ | ○ |
| 8 | PET | 200 | 23 | 300 | 25 | 0.30 | 28.5 | 0.204 | 1.0 | 0.06 | yes | 3.3 | 1.0 | ○ | ○ | ○ |
| 9 | PET | 200 | 23 | 300 | 25 | 0.30 | 29.8 | 0.203 | 0.5 | 0.08 | yes | 4.4 | 1.2 | ○ | ○ | ○ |
| 10 | OPP | 140 | 20 | 250 | 50 | 0.20 | 40.4 | 0.168 | 1.0 | 0.06 | yes | 3.6 | 1.1 | ○ | ○ | ○ |
| 11 | OPP | 140 | 20 | 250 | 50 | 0.20 | 40.4 | 0.106 | 0.1 | 0.08 | yes | 4.6 | 1.2 | ○ | ○ | ○ |
| 12 | ON | 120 | 22 | 170 | 50 | 0.30 | 44.9 | 0.158 | 0.5 | 0.06 | no | 4.7 | 1.2 | ○ | ○ | ○ |
| 13 | ON | 120 | 22 | 170 | 50 | 0.30 | 44.9 | 0.181 | 1.0 | 0.04 | yes | 3.4 | 1.0 | ○ | ○ | ○ |
| 14 | PET | 200 | 23 | 300 | 25 | 0.30 | 40.4 | 0.178 | 1.0 | 0.08 | yes | 5.7 | 1.6 | ○ | ○ | ○ |
| 15 | PET | 200 | 23 | 300 | 25 | 0.30 | 44.9 | 0.184 | 0.1 | 0.08 | no | 6.4 | 2.3 | ○ | ○ | ○ |
| 16 | PET | 200 | 23 | 300 | 25 | 0.20 | 50.2 | 0.106 | 0.5 | 0.08 | yes | 5.7 | 1.8 | ○ | ○ | ○ |
| 17 | PET | 200 | 23 | 300 | 25 | 0.30 | 55.5 | 0.174 | 0.5 | 0.06 | yes | 6.0 | 2.0 | ○ | ○ | ○ |

What is claimed is:

1. An easy opening can end comprising:

a can end panel made of steel sheet, said steel sheet having both sides coated with resin layers which each comprise at least one type of thermoplastic resin, and said resin layers having elongation after break of 100% or more, tensile strength of 10 kg/mm$^2$ or more, Young modulus of 100 kg/mm$^2$ or more and a thickness in range of 10 to 100 $\mu$m, and a score formed on at least one of a front or a back side of said can end panel, said score being capable of breaking for opening the can end, said score having a bottom cross-section in a shape of an arc having a radius in a range of 0.10 to 1.0 mm, and said score having a thinnest section having a thickness t in a range of 0.025 to 0.080 mm.

2. An easy opening can end according to claim 1, wherein said resin layers include at least one layer of polyester resin.

3. An easy opening can end according to claim 1, wherein a tension breaking force P expressed by the following equation ranges from 2.5 to 5.0;

$$P=t\times TS\times\{\exp(n)/n^n\}\times\{2\times 3^{-1/2}\times|\ln[1+(t-t_o)/t_o]|\}^n$$

where $t_o$: thickness (mm) of the steel sheet;

n: work hardening coefficient of uniform elongation in a range of 40 to 90%; and TS: tensile strength (kg/mm$^2$) of the steel sheet.

4. An easy opening can end according to claim 3, wherein said resin layers include at least one layer of polyester resin.

5. A method for fabricating an easy opening can end comprising:

working a steel sheet to form a can end panel, said steel sheet having both sides coated with resin layers which each comprise at least one thermoplastic resin, and said resin layers having elongation after break of 100% or more, tensile strength of 10 kg/mm$^2$ or more, Young modulus of 100 kg/mm$^2$ or more and a thickness in a range of 10 to 100 $\mu$m;

forming a score on said can end panel by press working using a pair of dies, wherein at least one of said dies comprises a curved surface of a radius in a range of 0.10 to 1.0 mm, and wherein said score is formed to have a thinnest section having a thickness in a range of 0.025 to 0.080 mm.

6. A method for fabricating an easy opening can end according to claim 5, wherein a tension breaking force P expressed by the following equation ranges from 2.5 to 5.0;

$$P=t\times TS\times\{\exp(n)/n^n\}\times\{2\times 3^{-1/2}\times|\ln[1+(t-t_o)/t_o]|\}^n$$

where $t_o$: thickness (mm) of the steel sheet;

n: work hardening coefficient of uniform elongation in a range of 40 to 90%; and TS: tensile strength (kg/mm$^2$) of the steel sheet.

7. A method for fabricating an easy opening can end according to claim 5, wherein at least one of a liquid or solid lubricant is used for press working said score.

8. A method for fabricating an easy opening can end according to claim 6, wherein at least one of a liquid or solid lubricant is used for press working said score.

* * * * *